US005509542A

United States Patent [19]

Simmerman et al.

[11] Patent Number: 5,509,542

[45] Date of Patent: Apr. 23, 1996

[54] APPARATUS FOR RETAINING HANGERS

[75] Inventors: Richard H. Simmerman, Palatine; Leonard B. J. Woloszyk, Mt. Prospect, both of Ill.

[73] Assignee: Richard H. Simmerman, Palantine, Ill.

[21] Appl. No.: 377,444

[22] Filed: Jan. 24, 1995

[51] Int. Cl.[6] ..... A47F 5/00

[52] U.S. Cl. ..... 211/124; 211/7

[58] Field of Search ..... 211/4, 7, 8, 124, 211/105.1, 123

[56] References Cited

U.S. PATENT DOCUMENTS

| | | | |
|---|---|---|---|
| 3,419,154 | 12/1968 | Shapiro et al. . | |
| 3,472,385 | 10/1969 | Shapiro et al. . | |
| 3,581,905 | 6/1971 | Shapiro et al. . | |
| 3,610,423 | 10/1971 | Parillo . | |
| 3,659,721 | 5/1972 | Parillo | 211/7 |
| 3,692,218 | 9/1972 | Friedman . | |
| 3,868,906 | 3/1975 | Cameron . | |
| 4,037,728 | 7/1977 | Cameron . | |
| 4,079,840 | 3/1978 | Usner . | |
| 4,340,145 | 7/1982 | Cameron . | |
| 4,494,896 | 1/1985 | DiFranco | 211/7 X |
| 4,732,270 | 3/1988 | Myers et al. . | |
| 4,735,534 | 4/1988 | Oehlke . | |
| 4,753,355 | 6/1988 | Hall et al. . | |
| 4,793,472 | 12/1988 | Solund . | |
| 4,858,870 | 8/1989 | Mazzanti . | |
| 4,887,727 | 12/1989 | Simmerman et al. . | |
| 5,092,473 | 3/1992 | Zelniker . | |
| 5,251,767 | 10/1993 | Wiederer . | |

FOREIGN PATENT DOCUMENTS

| | | |
|---|---|---|
| 2044094 | 10/1980 | United Kingdom . |

*Primary Examiner*—Robert W. Gibson, Jr.
*Attorney, Agent, or Firm*—Speckman, Pauley & Fejer

[57] ABSTRACT

An apparatus for retaining mounted garment hangers or other hook-shaped members on a hanger rod. A housing is mounted with respect to the hanger bar. The housing has a bore within which a pin is slidably mounted. A retaining rod is secured with respect to the pin so that the retaining rod follows sliding movement of the pin with respect to the housing. A bias force urges the pin into a normally open position. A lock member is mounted within another bore within the housing, so that the lock member slides with respect to the housing. The pin and the lock member preferably engage with each other to actuate the pins between an open position and a locked position. In the locked position of the pin, the retaining bar forces the garment hangers or other hook-shaped members against the hanger rod.

26 Claims, 3 Drawing Sheets

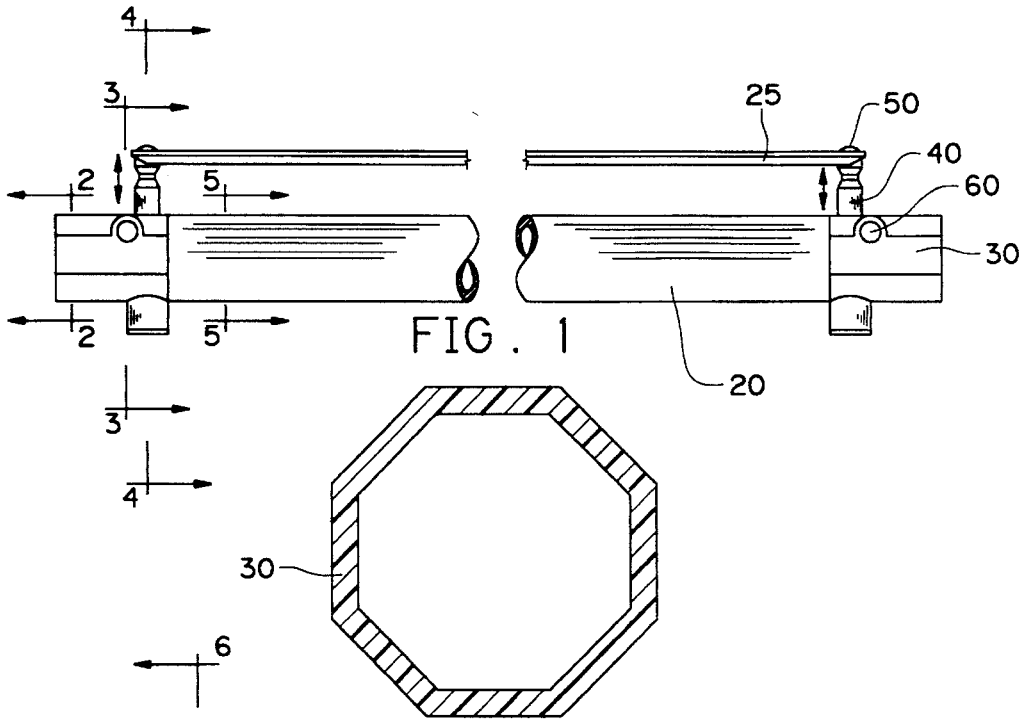
FIG. 1
FIG. 2
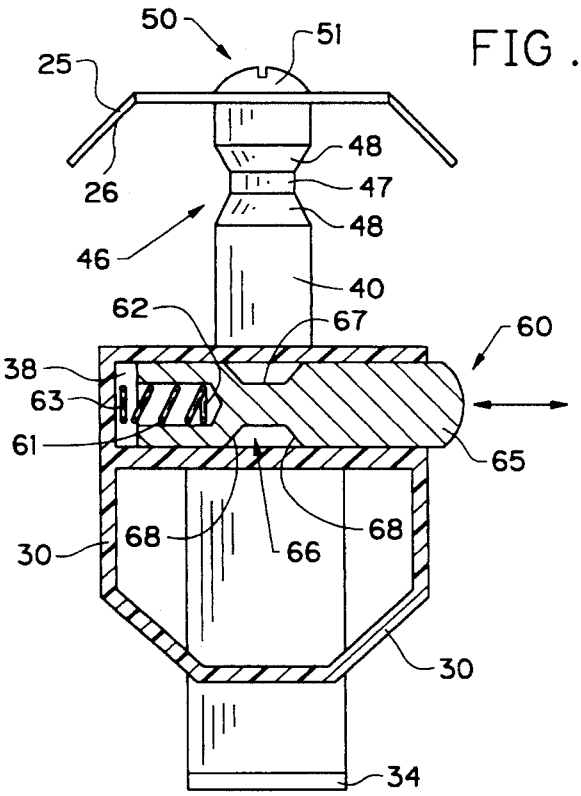
FIG. 3
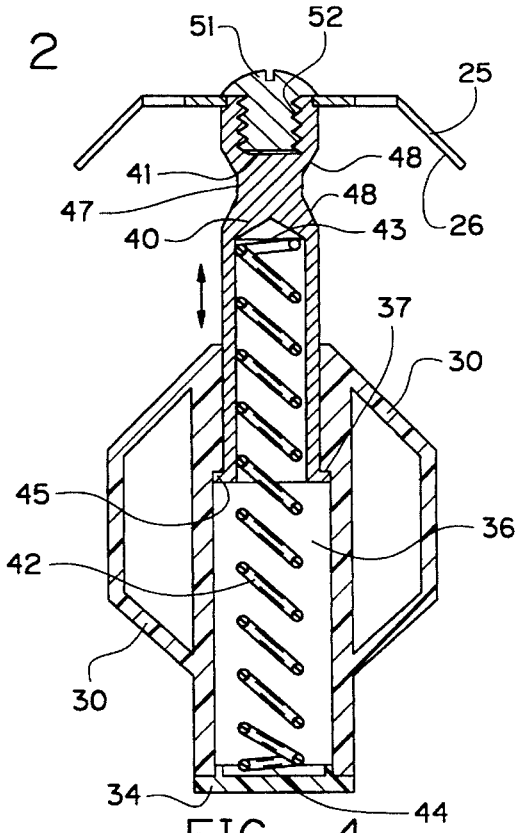
FIG. 4

APPARATUS FOR RETAINING HANGERS

BACKGROUND OF THE INVENTION

1. Field of the Invention

This invention relates to an apparatus having a hanger rod and a retaining bar which moves with respect to the hanger rod. Garment hangers or other hook-shaped members are mounted upon the hanger rod and the retaining bar is secured to at least one pin, preferably two pins. Each pin moves with respect to the hanger rod thereby allowing the retaining member to move between an open position and a locked position, with respect to the hanger rod.

2. Description of Prior Art

Clothing retailers have found that displaying merchandise on garment hangers increases sales. Most retailers keep the hanger when a garment is sold and re-use the hanger for displaying replenishment merchandise. Collecting hangers at the point of sale, sorting them, and re-using them causes attendant operational problems for retailers. Nonetheless, overall operating expenses decline as a result of the undertaking.

Hanger storage assemblies have been used to handle or store garment hangers in a neat and organized fashion between a hanger bar and a retainer bar. Most conventional hanger storage assemblies either use a pin which is secured to the hanger bar and a retaining bar which slides with respect to the pin, or use a retaining bar which is secured to a latching member which is formed as a leaf spring.

Cameron, U.S. Pat. No. 4,340,145, teaches a caddy for garment hangers. An end plug having a hollow cylindrical shape is inserted into a tube. The inserted portion of the end plug is slightly smaller in diameter than an outer portion of the end plug. A shoulder is defined at the junction between the inserted portion and the outer portion. The inner portion has shallow projections, in the form of longitudinally extending ribs, peripherally spaced about the exterior surface, which are used to form a tight fit between the end plug and the tube. A hanger clamping member is secured to a pair of latching members, each in the form of a leaf spring. Each leaf spring projects through holes in the tube. As the clamping member moves toward the tube, each leaf spring reaches a position at which it springs into a locked position.

Simmerman et al., U.S. Pat. No. 4,887,727, teaches a garment hanger assembly which also has a retaining member secured to a pair of latching members, each in the shape of a leaf spring. The leaf springs project through holes in end caps. The end caps are attached to a hanger bar. When the retaining member reaches a certain position, the leaf springs move into a locked position.

Cameron, U.S. Pat. No. 3,868,906, discloses a caddy for storing garment hangers. The caddy includes a tube and a retainer strip that is secured to a pair of latching members. Each latching member is formed as a leaf spring. The latching mechanisms taught by the '906 Cameron patent can permanently deform through repeated use, rendering the caddy quite difficult to use in actual practice.

Hall et al., U.S. Pat. No. 4,753,355, discloses a hanger storage assembly having a pin that is secured with respect to a hanger bar. A retaining member slides with respect to the pin, between an open position and a closed position. A resilient latch member having serrations is used to lock the retaining member in a set position. A spring positioned between the hanger bar and the retaining bar urges the retaining bar away from the hanger bar when the retaining bar is unlatched.

Zelniker, U.S. Pat. No. 5,092,473, teaches a hanger retaining device which has retaining pins mounted on a hanger bar. A retaining rod is slidably mounted on the retaining pins, so that the retaining rod slides with respect to the retaining pins. A spring is positioned between the retaining rod and the hanger bar and urges the retaining rod away from the hanger bar, toward a normally open position.

Wiederer, U.S. Pat. No. 5,251,767, discloses an end cap which fits into an end of a tubular member of a garment hanger caddy. A groove is cut at least partially around the end cap between the inner portion which fits within the tubular member and the outer portion which forms the exposed end cap. The external surface of the inner portion is formed by raised splines which are separated by substantially planar flats.

Any improvement, particularly those associated with operating and handling the garment hangers, will render retail operations more efficient and thus be advantageous for the consumer.

SUMMARY OF THE INVENTION

It is one object of this invention to provide a simple and understandable lockable storage apparatus having an easy-opening retaining member wherein a locking or actuating mechanism is encapsulated in an endcap housing, which protects the locking or actuating mechanism from damage and insures long life.

It is another object of this invention to provide a lockable storage apparatus having a simple compact design that provides increased hanger storage capacity, when compared with some other conventional hanger storage assemblies.

It is another object of this invention to provide a lockable storage apparatus wherein all biasing elements are completely encapsulated within the endcap housings, thereby protecting the biasing elements from damage and promoting long life.

It is another object of this invention to provide a lockable storage apparatus wherein the useful life is increased because there are no loose pieces that can fail or become dislodged.

It is another object of this invention to provide a lockable storage apparatus wherein rotation of a locking pin will not alter the operation of the locking or actuating mechanism.

It is another object of this invention to provide a lockable storage apparatus wherein the locking or actuating mechanism cannot be opened or unlocked by inertial forces while transporting the lockable storage apparatus.

It is another object of this invention to provide a lockable storage apparatus having a fixed construction which provides easy movement of a retaining bar between an open position and a locked position, with respect to a hanger rod.

It is another object of this invention to provide a lockable storage apparatus wherein opposite end portions of a retaining bar are each secured with respect to a pin that slides within a bore of a housing that is secured with respect to a hanger rod.

Garment hangers are often gathered for reuse. For example, retail clothing stores often remove garment hangers from clothing items at the time of sale. Clerks often have insufficient time to neatly stack the empty garment hangers. Many conventional storage devices used to collect and store garment hangers are awkward to use. There is an apparent need for a hanger storage apparatus which reduces or eliminates time-consuming fidgeting associated with mechanical components that are awkward to move between an open position and a locked position.

The above and other objects of this invention are accomplished with a lockable storage apparatus that has a simple actuating mechanism which is easily operated between open and closed positions. The lockage storage apparatus for retaining garment hangers or other hook-shaped members, according to one preferred embodiment of this invention, two housing member's each attached at opposite ends of an elongated hanger member, such as a hanger rod. A pin is slidably mounted within a housing bore of each housing member. A spring is preferably used to urge the pin into a normally open position.

An actuating mechanism is used to operate the pin between the open position and the locked position. Because an elongated retaining member, such as a retaining bar, is secured with respect to the pin, the retaining member follows movement of the pin.

In one preferred embodiment according to this invention, two pins are positioned approximately parallel to each other and the retaining member is secured either directly or indirectly to upper portions of the pins. With such arrangement, a user can easily depress each pin from the open position to the locked position, thereby closing the distance between the retaining bar and the hanger member so that the retaining member can move into the locked position and forcibly hold each hanger against the hanger member.

In one preferred embodiment according to this invention, each pin is released from the locked position by overcoming a bias force which urges a lock member into an engaged position. The lock member is preferably but not necessarily slidably mounted within another bore of the housing. When the pin is in the locked position, the lock member preferably projects from the housing at its maximum travel distance. As the lock member is forced into the housing, a step depression or notch within the lock member preferably engages with the pin in such a manner that the spring-loaded pin automatically moves into the open position.

The lockable apparatus for retaining garment hangers, according to this invention, can be easily handled by the user. Because of the relatively fixed construction accomplished by having the retaining member secured with respect to the slidable pins, the user can apply a closing force to any portion of the retaining member and easily actuate the retaining member from the open position to the locked position.

The lockable storage apparatus according to this invention can be easily moved from the open position to the locked position, even with only one hand of the user. The lock members of this invention preferably protrude from the housing in the general shape of a pushbutton. Such pushbuttons are conveniently located near the user's thumb when the user grasps and holds the housing member with one hand. Thus, at times when the user can afford only one hand to close a storage apparatus, the lockable storage apparatus according to this invention enables the user to conveniently move the retaining member from the open position to the locked position. The spring-loaded pushbutton motion for actuating the pins from the locked position to the open position provides the user with a simple touch motion to open the retaining member, for example when adding more garment hangers or other hook-shaped members to the hanger member.

BRIEF DESCRIPTION OF THE DRAWINGS

The above-mentioned and other features and objects of this invention will be better understood from the following detailed description taken in conjunction with the drawings wherein:

FIG. 1 is a front view of a lockable storage apparatus, according to one preferred embodiment of this invention;

FIG. 2 is a sectional view of a housing member, taken along line 2—2, as shown in FIG. 1;

FIG. 3 is a sectional view taken along line 3—3 of the lockable hanger apparatus as shown in FIG. 1;

FIG. 4 is a sectional view taken along line 4—4, of the lockable hanger apparatus as shown in FIG. 1;

DESCRIPTION OF PREFERRED EMBODIMENTS

Figure 5:
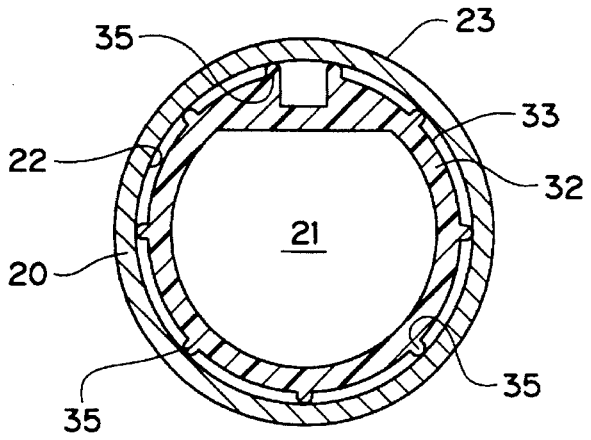
FIG. 5 is a sectional view taken along line 5—5, of the housing and the hanger member, as shown in FIG. 1.

Referring to FIG. 1 which shows a front view of a lockable hanger apparatus, according to one preferred embodiment of this invention, garment hangers or other hook-shaped members can be mounted upon an elongated hanger member, such as hanger rod 20. Hanger rod 20 can have any suitable cross-sectional shape that accommodates garment hangers or other hook-shaped members.

Housing 30 is mounted, attached or otherwise secured with respect to hanger rod 20. As shown in FIG. 1, preferably two housings 30 are each mounted at opposite ends of hanger rod 20. Each housing 30 has pin bore 36, as shown in FIG. 4, which accommodates pin 40 and allows pin 40 to slide with respect to housing 30. Pin 40 is preferably positioned generally perpendicular to both a longitudinal axis of hanger rod 20 and a general longitudinal axis of housing 30.

As clearly shown in FIGS. 1, 3 and 4, an elongated retaining member, such as retaining bar 25, is secured with respect to pin 40. With such secured arrangement, retaining bar 25 follows the sliding movement of pin 40, with respect to housing 30.

As shown in FIG. 1, pin 40 is in an open position. The gap between retaining bar 25 and hanger rod 20 is preferably large enough to allow hangers or other hook-shaped members to be mounted upon hanger rod 20. Once in the mounted position, pin 40 can be pushed in a direction generally parallel to a longitudinal axis of pin 40, resulting in retaining bar 25 moving toward hanger rod 20. Hanger rod 20, retaining bar 25 and pin 40 can be designed and sized so that in a locked position of pin 40, retaining bar 25 exerts a clamping force upon the hangers or other hook-shaped members. Although not shown in the drawings, a deformable strip of material can be adhered or otherwise attached to clamping surface 26. Such material may comprise a foam material, a polymeric material, or any other suitable material for providing a clamping force, as known to those skilled in the art.

The lockable hanger apparatus according to this invention is easily actuated between the open position and the locked position of pin 40. Bias means are used to urge pin 40 into a fully open position, as shown in FIG. 4. In such open position, garment hangers or other hook-shaped members can be easily mounted upon hanger rod 20. Once in a mounted position, a closing force can be applied to pin 40 and/or retaining bar 25. Because retaining bar 25 is secured with respect to preferably two pins 40, a relatively fixed 3-bar member is formed. Thus, if a closing force is applied at a position other than the center of retaining bar 25 or at a location at or near either of pins 40, such closing force will be distributed through retaining bar 25 and directly into pins 40. In one preferred embodiment according to this invention, such closing force distribution prevents retaining bar 25 from canting with respect to hanger rod 20, particularly during the closing motion.

FIG. 2 shows one preferred embodiment of a peripheral shape of housing 30. The external peripheral shape of housing 30 shown in FIG. 2 is particularly suitable for supporting the lockable hanger apparatus according to this invention, such as when the apparatus is not in use. It is apparent that any other suitable peripheral shape can be substituted for that shown in FIG. 2 without departing from the results achieved with this invention.

Figure 6:
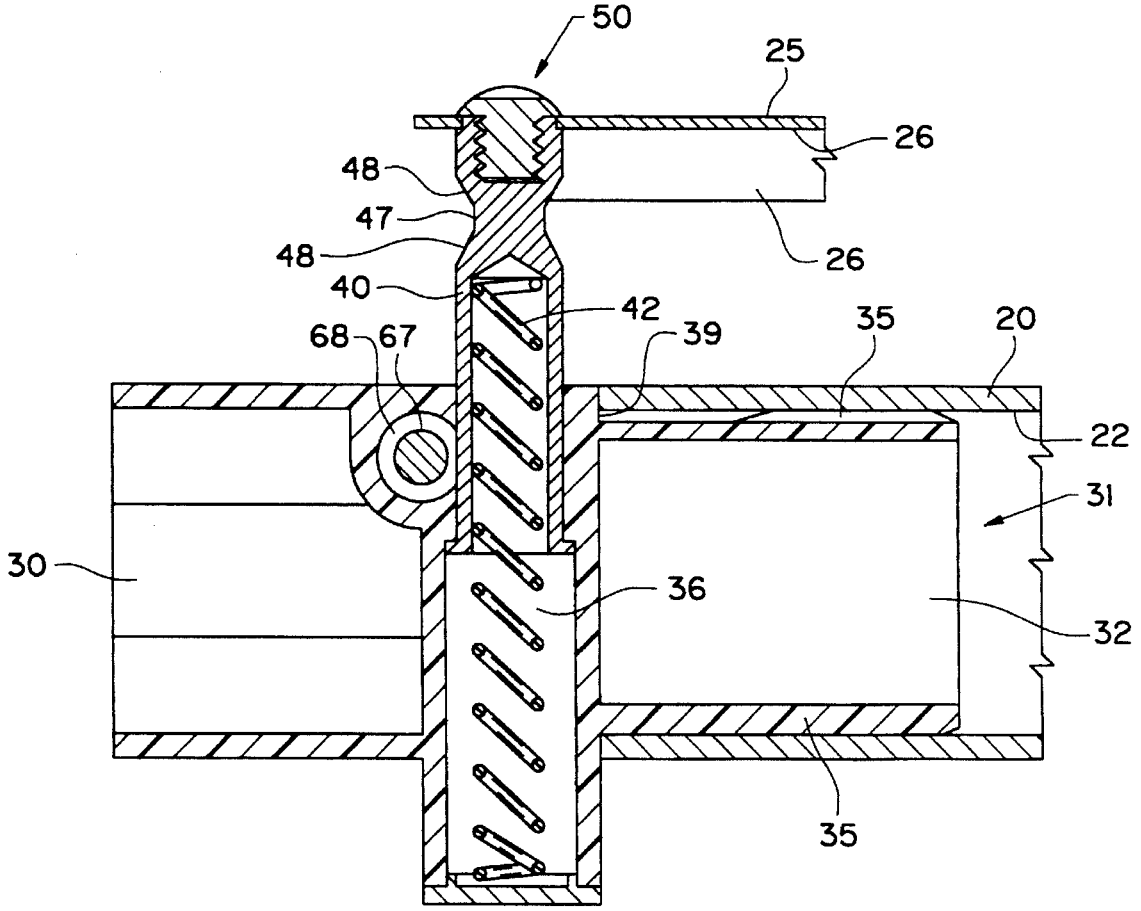
FIG. 6 is a sectional view of the lockable hanger apparatus with a pin in an open position, taken along line 6—6, as shown in FIG. 3.

As clearly shown in FIG. 6, connector 31 extends from housing 30. It is apparent that connector 31 can be integrally formed with housing 30 or connector 31 can be secured or attached to housing 30, such as in any suitable manner known to those skilled in the art. According to one preferred embodiment of this invention, as shown in FIGS. 5 and 6, hanger rod 20 is formed as a tube which defines opening 21. In such preferred embodiment, connector 31 comprises extension 32 which is mateably mounted with an opening 21. It is apparent that the roles between opening 21 and connector 31 can be reversed so that hanger rod 20 has an extension and connector 31 forms an opening.

Figure 7:
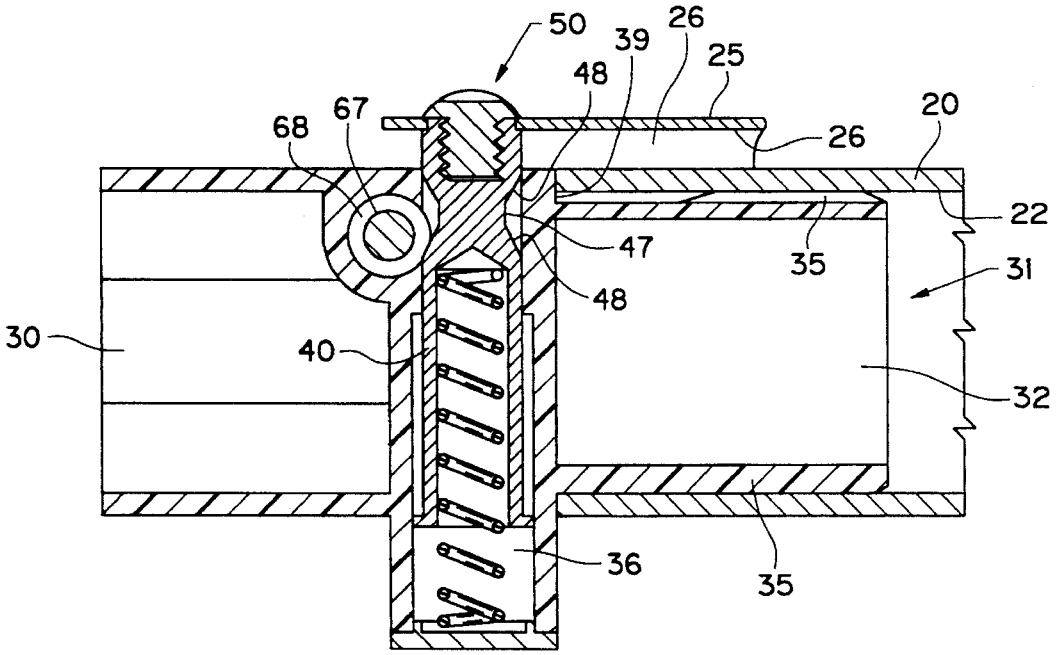
FIG. 7 is a sectional view of the lockable hanger apparatus as shown in FIG. 6, but with a pin in a locked position.

Also as clearly shown in FIGS. 5 and 6, at least one crush rib 35 is preferably positioned between outer surface 33 of extension 32 and inner surface 22 of hanger rod 20. As shown in FIG. 6, in a direction from right-to-left, the top crush rib 35 stops short of shoulder 39. Crush rib 35 preferably tapers toward the external surface of extension 32, as shown in FIG. 6. However, crush rib 35 can also form a curved, a square or any other suitable shaped end shoulder at the transition into extension 32. FIG. 7 shows the lockable storage apparatus shown in FIG. 6, but with pin 40 in a locked position.

As clearly shown in FIGS. 3 and 4, retaining member 25 preferably has clamping surface 26 facing toward hanger rod 20. In one preferred embodiment according to this invention, clamping surface 26 generally conforms to and matches external surface 23, as shown in FIG. 5, of hanger rod 20. As shown in FIGS. 3 and 4, retaining bar 25 has two angled flanges which generally conform to the overall arcuate peripheral shape of external surface 23. The generally matching shapes promote the clamping effect achieved between retaining bar 25 and hanger rod 20.

In one preferred embodiment according to this invention, securement means are used to secure retaining bar 25 with respect to pin 40. As clearly shown in FIGS. 3 and 4, fastener 50 is used to detachably secure retaining bar 25, directly to pin 40. As shown in FIG. 4, fastener 50 may comprise screw 51 having external threads 52 which are mateably engaged within internally threaded bore 41 of pin 40. As shown in FIGS. 3 and 4, retaining bar 25 is sandwiched between pin 40 and a head of screw 51. It is apparent that any other suitable method for permanently securing or detachably securing retaining bar 25, either directly to pin 40 or with respect to pin 40, can be used without departing from the result of forming a relatively fixed construction between retaining bar 25 and pin 40. It is apparent that rivets, welding, adhesives and integrally formed parts can be used as a substitute for fastener 50 or screw 51.

Bias means are used to urge pin 40 into a normally open position, such as the position shown in FIGS. 3 and 4. In one preferred embodiment according to this invention, such bias means comprise compression spring 42 at least partially positioned within pin bore 36. Compression spring 42 preferably has spring end 43 abutting pin 40 and opposite spring end 44 abutting housing 30. It is apparent that many other suitable biasing members, such as various types of springs, deformable elements and the like, can be used to accomplish the same result of urging pin 40 into the open position, as shown in FIGS. 3 and 4. As shown in FIGS. 3 and 4, cap 34 closes pin bore 36. Cap 34 can form an interference fit with the sidewalls of housing 30 that define pin bore 36. Cap 34 can also be permanently secured to housing 30. However, a removable cap 34 allows disassembly and removal of pin 40 from housing 30, if desired.

Pin 40 slides within pin bore 36, in a direction which is generally parallel to a longitudinal axis of pin 40. In one preferred embodiment according to this invention, the travel of pin 40 in the opening direction is limited by shoulder stop 37 of housing 30 which abuts flange 45 of pin 40, in the fully open position as shown in FIG. 4. It is apparent that the travel distance and shape of pin 40 can be changed to accomplish the desired results of this invention.

According to one preferred embodiment of this invention, as shown in FIG. 3, such bias means comprise spring 61 at least partially mounted within lock bore 38. Compression spring 61 has spring end 62 abutting plunger shaft 65 and opposite spring end 63 abutting housing 30. Plunger shaft 65 preferably slides in a direction that is generally perpendicular to the longitudinal axis of pin 40. As shown in FIG. 3, plunger shaft 65 is preferably positioned generally perpendicular to both a longitudinal axis of pin 40 and a longitudinal axis of hanger rod 20.

In another preferred embodiment according to this invention, actuating means are used to operate or actuate pin 40 between the open position and the locked position. The actuating means may comprise lock member 60 being slidably mounted with respect to housing 30. Lock member 60 can comprise any suitable mechanical element that directly or indirectly contacts pin 40 to allow pin 40 to be set in either the locked position or the open position. As shown in FIG. 3, lock member 60 comprises plunger shaft 65 which is slidably mounted within lock bore 38. Bias means are also preferably used to urge plunger shaft 65 toward an engaged position. Engagement means are used to position plunger shaft 65 in the engaged position when pin 40 is in the locked position. Such engagement means are also used to position plunger shaft 65 in a release position when pin 40 is out of the locked position, such as either in the open position or moving toward the open position of pin 40.

Figure 8:
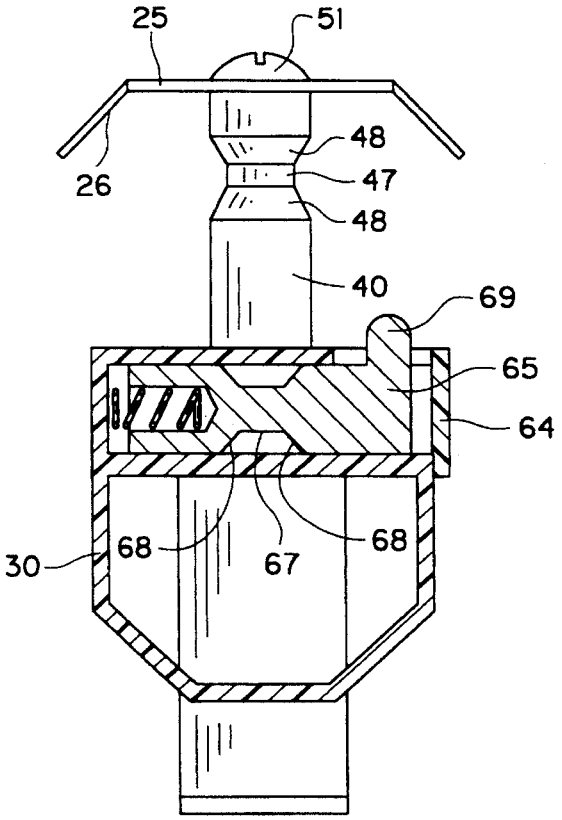
FIG. 8 is a sectional view, similar to that shown in FIG. 3, of a lockable hanger apparatus, according to still another preferred embodiment of this invention.
Figure 9:
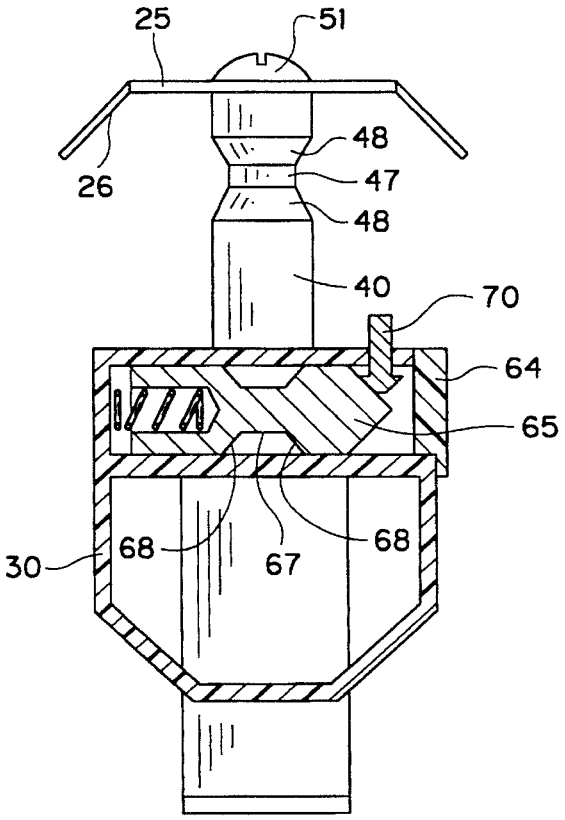
FIG. 9 is a sectional view, similar to that shown in FIG. 3, of a lockable hanger apparatus, according to yet another preferred embodiment of this invention.

FIGS. 8 and 9 show different embodiments of the lockable hanger apparatus according to this invention, similar to that shown in FIGS. 3 and 4. As shown in FIG. 3, plunger shaft 65 is mounted within lock bore 38 which has no cap. According to the embodiment shown in FIG. 3, the contact between plunger shaft 65 and pin 40 always retains plunger shaft 65 within lock bore 38. In the embodiment shown in FIG. 8, cap 64 which is either integrally formed with or attached to body 30, forms a stop and limits movement of plunger shaft 65. As shown in FIG. 8, the actuating means comprise tab 69 which is used to operate plunger shaft 65 between the engage position and the release position. As shown in FIG. 9, slide key 70 is used to control movement of plunger shaft 65. By moving slide key 70 downward, as shown in FIG. 9, plunger shaft 65 slides to the left.

According to one preferred embodiment of this invention, the engagement means comprise at least a portion of plunger shaft 65 having notch or step depression 66, as shown in FIG. 3. Step depression 66 is preferably formed by plunger shaft 65 having shaft neck 67 and at least one bevelled collar 68 which forms a transition between the diameter of shaft neck 67 and the diameter of plunger shaft 65. As shown in FIG. 3, two bevelled collars 68 form the transition and thus step depression 66. Likewise, according to one preferred embodiment of this invention, pin 40 is preferably formed as a rod having step depression 46. As shown in FIG. 3, bevelled collars 48 are positioned on opposing sides of rod neck 47 and form a transition between a diameter of rod neck 47 and a diameter of rod or pin 40.

In one preferred embodiment according to this invention, the included acute angle formed between bevelled collar 48 and pin 40 and the included acute angle formed between bevelled collar 68 and plunger shaft 65 add to approximately 90°. With such arrangement the actuating means operates with ease. However, it is apparent that other suitable angles can be used, depending upon the materials selected for pin 40 and plunger shaft 65, for example.

Lock member 60 or plunger shaft 65 is in a release position whenever pin 40 is out of the locked position. As shown in FIG. 3, pin 40 is in the open position and plunger shaft 65 is in the release position, wherein the major diameter of pin 40 fits within step depression 66 of plunger shaft 65. As pin 40 is forced downward, relative to the direction shown in FIGS. 3 and 4, step depression 46 of pin 40 eventually engages with step depression 66 of plunger shaft 65. Upon such engagement between step depression 46 and step depression 66, the bias force slides plunger shaft 65 to the right, preferably along a linear direction shown by the double-headed arrow in FIG. 3, until bevelled collar 68 abuts bevelled collar 48.

In the preferred embodiment of this invention as shown in FIGS. 3 and 4, both pin 40 and plunger shaft 65 have a circular cross section. Thus, bevelled collar 48 and bevelled collar 68 are each formed as truncated cones. With such geometrical arrangement, bevelled collar 48 and bevelled collar 68 contact each other. In such arrangement, only one bevelled collar 48 is necessary on pin 40 and only one bevelled collar 68 is necessary on plunger shaft 65. The shape of the structures of step depression 46 and step depression 66 are not limited to those shown in the drawings. Other suitably designed notches or depressions can be used to accomplish the same results of pin 40 interfering with plunger shaft 65 and the bias force urging plunger shaft 65 when pin 40 is in the open position, and of plunger shaft 65 interfering with pin 40 and the bias force urging pin 40 when pin 40 is in the locked position.

It is apparent that the elements and components discussed throughout this specification and shown in the drawings can be constructed of many different suitable materials. For example, pin 40 can be constructed of a durable metal., such as steel. Pin 40 can also be injection molded with a suitable polymeric or composite material. Housing 30 is preferably injection molded with a suitable polymeric or composite material. Hanger rod 20 and retaining bar 25 are preferably constructed of metal, but can also be constructed of other suitably strong materials, such as graphite, graphite composites and the like.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. In an apparatus for retaining hook-shaped members, the apparatus having an elongated hanger member, the improvement comprising:

a housing mounted with respect to the hanger member, a pin slidably mounted with respect to said housing, an elongated retaining member;

securement means for securing said retaining member with respect to said pin so that said retaining member follows sliding movement of said pin with respect to said housing;

first bias means for urging said pin into an open position; and actuating means for operating said pin between said open position and a locked position, said actuating means comprising a lock member slidably mounted with respect to said housing, second bias means for urging said lock member toward an engage position, and engagement means for positioning said lock member in said engage position when said pin is in said locked position and for positioning said lock member in a release position when said pin is out of said locked position.

2. In an apparatus according to claim 1 further comprising a connector secured with respect to said housing, said connector extending from said housing, and said connector attached to the hanger member.

3. In an apparatus according to claim 2 wherein the hanger member comprises a tube, and said connector is mateably attached to said tube.

4. In an apparatus according to claim 3 wherein said connector is a male extension of said housing, said tube has a female opening, and said male extension is mateably mounted within said female opening.

5. In an apparatus for retaining hook-shaped members, the apparatus having an elongated hanger member, the improvement comprising:

a housing mounted with respect to the hanger member, a pin slidably mounted with respect to said housing, an elongated retaining member;

securement means for securing said retaining member with respect to said pin so that said retaining member follows sliding movement of said pin with respect to said housing;

first bias means for urging said pin into an open position;

actuating means for operating said pin between said open position and a locked position;

a connector secured with respect to said housing, said connector extending from said housing, said connector being a male extension of said housing, the hanger member comprising a tube having a female opening, and said male extension being mateably mounted within said female opening; and at least one crush rib positioned between and contacting an outer surface of said male extension and an inner surface of said tube.

6. In an apparatus according to claim 1 wherein said elongated retaining member has a clamping surface that generally conforms to a matching external surface of the hanger member.

7. In an apparatus according to claim 1 wherein said securement means comprise: a fastener, and said fastener contacting said pin and said retaining member.

8. In an apparatus for retaining hook-shaped members, the apparatus having an elongated hanger member, the improvement comprising;

a housing mounted with respect to the hanger member, a pin slidably mounted with respect to said housing, an elongated retaining member;

securement means for securing said retaining member with respect to said pin so that said retaining member follows sliding movement of said pin with respect to said housing, said securement means comprising a screw, said screw contacting said pin and said retaining member;

said screw having external threads, said pin having an internally threaded bore, said external threads mateably engaged within said internally threaded bore, and said retaining member sandwiched between said pin and a head of said screw; and first bias means for urging said pin into an open position; and actuating means for operating said pin between said open position and a locked position.

9. In an apparatus according to claim 1 wherein said first bias means comprise a compression spring having a first spring end abutting said housing and a second spring end abutting said pin.

10. In an apparatus according to claim 9 wherein said housing has a pin bore, said pin is slidably mounted within said pin bore to slide in a direction parallel to a longitudinal axis of said pin, and said compression spring is at least partially positioned within said pin bore.

11. In an apparatus according to claim 1 wherein said housing has a pin bore, said pin is slidably mounted within said pin bore to slide in a direction parallel to a longitudinal axis of said pin, said housing forms a shoulder stop, and said pin has a flange that abuts said shoulder stop in said open position.

12. In an apparatus according to claim 11 further comprising: a cap detachably secured to said housing, and said cap covering said pin bore.

13. In an apparatus according to claim 1 wherein said second bias means comprise a compression spring having a first spring end abutting said housing and a second spring end abutting said lock member.

14. In an apparatus according to claim 1 wherein said housing has a lock bore, said lock member is slidably mounted within said lock bore to slide in a direction parallel to a lock member longitudinal axis of said lock member, and said compression spring is at least partially positioned within said lock bore.

15. In an apparatus according to claim 14 wherein said direction is generally perpendicular to a pin longitudinal axis of said pin.

16. In an apparatus according to claim 1 wherein said engagement means comprise: at least a portion of said lock member formed as a plunger shaft, said plunger shaft having a shaft step depression, and in said release position said pin engaged within said shaft step depression.

17. In an apparatus according to claim 16 wherein said shaft step depression is formed by said plunger shaft having a shaft neck with a shaft neck diameter less than a shaft diameter of said plunger shaft, and on at least one side of said shaft neck a shaft bevelled collar forming a transition between said shaft neck diameter and said shaft diameter.

18. In an apparatus according to claim 16 wherein said engagement means comprise: at least a portion of said pin formed as a rod, said rod having a rod step depression, and in said release position said pin engaged within said shaft step depression.

19. In an apparatus according to claim 18 wherein said rod step depression is formed by said rod having a rod neck with a rod neck diameter less than a rod diameter of said rod, and on at least one side of said rod neck a rod bevelled collar forming a transition between said rod neck diameter and said rod diameter.

20. In an apparatus according to claim 1 wherein said engagement means comprise: at least a portion of said pin formed as a rod, said rod having a rod step depression, and in said release position said pin engaged within a step depression of said lock member.

21. In an apparatus according to claim 20 wherein said rod step depression is formed by said rod having a neck with a neck diameter less than a rod diameter of said rod, and on at least one side of said neck a bevelled collar forming a transition between said neck diameter and said rod diameter.

22. In an apparatus for retaining hook-shaped members, the apparatus having an elongated hanger member, and a retaining bar that is actuated between an open position and a locked position with respect to the hanger member, the improvement comprising:

a pin, said pin secured with respect to said retaining member, mounting means for mounting said pin to slide with respect to the hanger member between the open position and the locked position, said pin having a pin step depression;

a plunger shaft slidably mounted with respect to said housing between an engage position when said pin is in the locked position and a release position when said pin is out of the locked position, said plunger shaft having a neck diameter of a neck of said plunger shaft less than a shaft diameter of said plunger shaft, on at least one side of said neck a bevelled collar forming a transition between said neck diameter and said shaft diameter, and said plunger shaft positioned at least partially within said pin step depression.

23. In an apparatus for retaining hook-shaped members, the apparatus having an elongated hanger member, the improvement comprising a housing mounted with respect to the hanger member, a pin slidably mounted with respect to said housing, an elongated retaining member;

securement means for securing said retaining member with respect to said pin so that said retaining member follows sliding movement of said pin with respect to said housing;

first bias means for urging said pin into an open position; and actuating means for operating said pin between said open position and a locked position, said actuating means comprising a lock member slidably mounted with respect to said housing, and engagement means for positioning said lock member in said engage position when said pin is in said locked position and for positioning said lock member in a release position when said pin is out of said locked position.

24. In an apparatus for retaining hook-shaped members, the apparatus having an elongated hanger member, and a retaining bar that is actuated between an open position and a locked position with respect to the hanger member, the improvement comprising:

a pin, said pin secured with respect to said retaining bar, mounting means for mounting said pin to slide with respect to the hanger member between the open position and the locked position, said pin having a pin step depression;

a plunger shaft slidably mounted with respect to said housing between an engage position when said pin is in the locked position and a release position when said pin is out of the locked position, said lock member having a lock member step depression, and said plunger shaft positioned at least partially within said pin step depression.

25. In an apparatus according to claim 24 wherein said pin step depression forms a square shoulder.

26. In an apparatus according to claim 24 wherein said lock member step depression forms a square shoulder.

* * * * *